US006074313A

United States Patent [19]

Pearson

[11] Patent Number: 6,074,313

[45] Date of Patent: Jun. 13, 2000

[54] BASKETBALL RETURN NET ASSEMBLY

[75] Inventor: Malcolm Pearson, Grimsby, Canada

[73] Assignee: Dicon Rose Inc., Grimsby, Canada

[21] Appl. No.: 09/176,751

[22] Filed: Oct. 22, 1998

Related U.S. Application Data

[60] Provisional application No. 60/063,168, Oct. 24, 1997.

[51] Int. Cl.[7] ..... A63B 69/00

[52] U.S. Cl. ..... 473/433; 473/447; 473/479; 273/394

[58] Field of Search ..... 473/433, 472, 473/447, 449, 197, FOR 212, FOR 100, FOR 101, 479, 481, 434, 435; 273/394, 395, 396, 397; 160/349.1

[56] References Cited

U.S. PATENT DOCUMENTS

| | | |
|---|---|---|
| 1,765,269 | 6/1930 | Hatley . |
| 3,227,449 | 1/1966 | Schwab . |
| 3,776,550 | 12/1973 | McNabb . |
| 3,901,506 | 8/1975 | Caveney . |
| 3,986,719 | 10/1976 | Lee . |
| 4,063,739 | 12/1977 | La Rose . |
| 4,153,246 | 5/1979 | Byrne . |
| 4,291,885 | 9/1981 | Cohen . |
| 4,762,319 | 8/1988 | Krumholz . |
| 4,786,371 | 11/1988 | Postol . |
| 4,979,754 | 12/1990 | Eisenhart . |
| 5,007,645 | 4/1991 | Weigl . |
| 5,016,875 | 5/1991 | Joseph . |
| 5,116,056 | 5/1992 | Schmutte . |
| 5,129,648 | 7/1992 | Sweeney et al. . |
| 5,312,099 | 5/1994 | Oliver . |
| 5,374,054 | 12/1994 | Suess . |
| 5,402,999 | 4/1995 | Keehn, Sr. . |
| 5,615,889 | 4/1997 | Long . |
| 5,785,616 | 7/1998 | Dodge . |

FOREIGN PATENT DOCUMENTS

| | | |
|---|---|---|
| 1265192 | 3/1972 | United Kingdom . |

OTHER PUBLICATIONS

Derwent Publication, XP–002090739, "Basketball Training Return Net . . . " Geraskin et al, see the abstract, Jun. 1987.

*Primary Examiner*—Sebastiano Passaniti
*Attorney, Agent, or Firm*—Robert F. Delbridge

[57] ABSTRACT

A basketball return net assembly attachable to a basketball hoop support behind a basketball hoop carried thereby has a flexible foldable return net having an upper end with an upper sleeve portion extending therealong, an elongated rigid net-carrying member removably insertable into the upper sleeve portion to enable the net to be suspended in a laterally-extended configuration from the net-carrying member, and at least one attachment member for securing the net-carrying member to an upper portion of the hoop support behind the hoop. The net also has a lower end portion for receiving ballast to retain the lower end of the net in a laterally extended configuration at a selected location on the ground.

26 Claims, 7 Drawing Sheets

Figure 1:
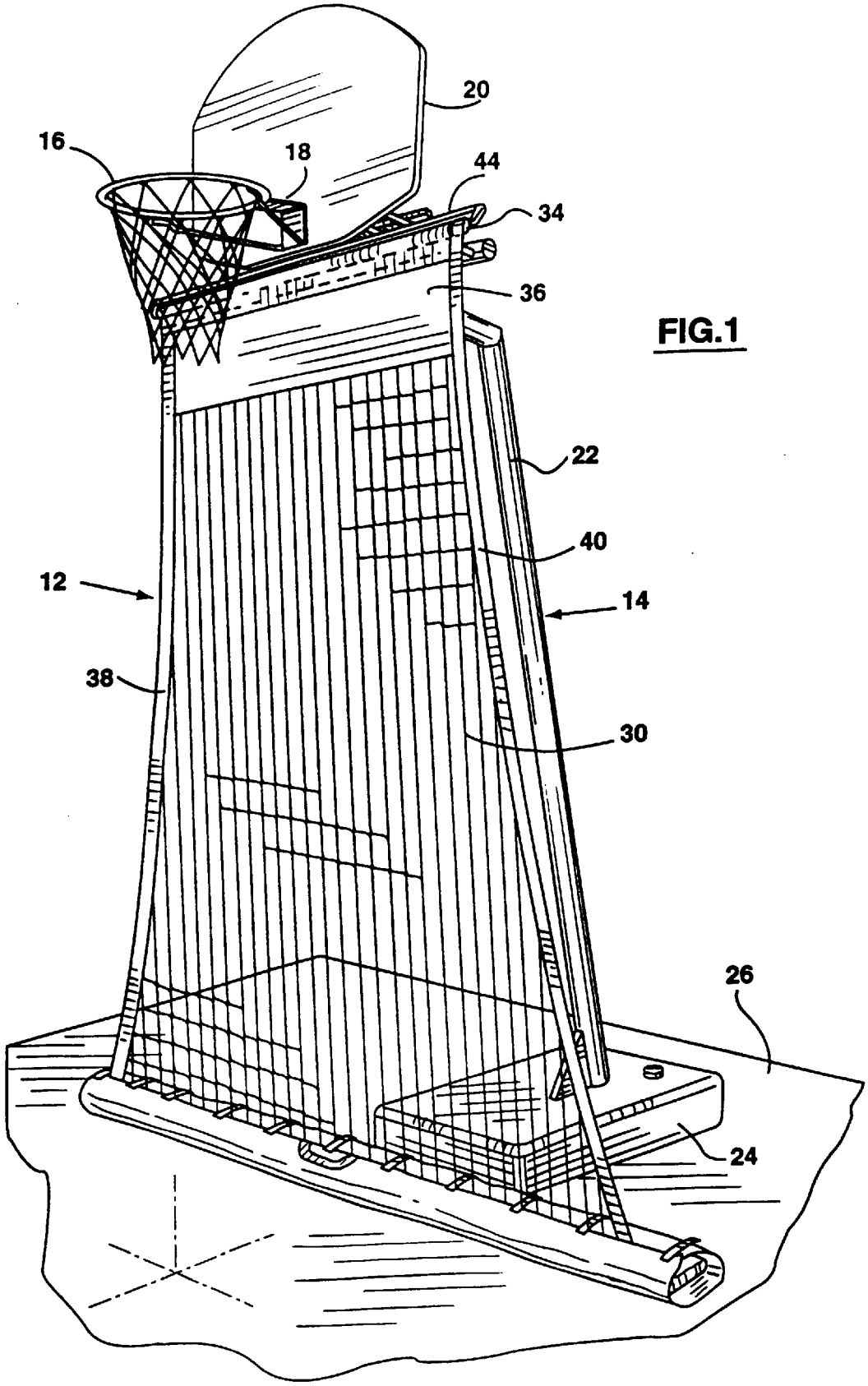

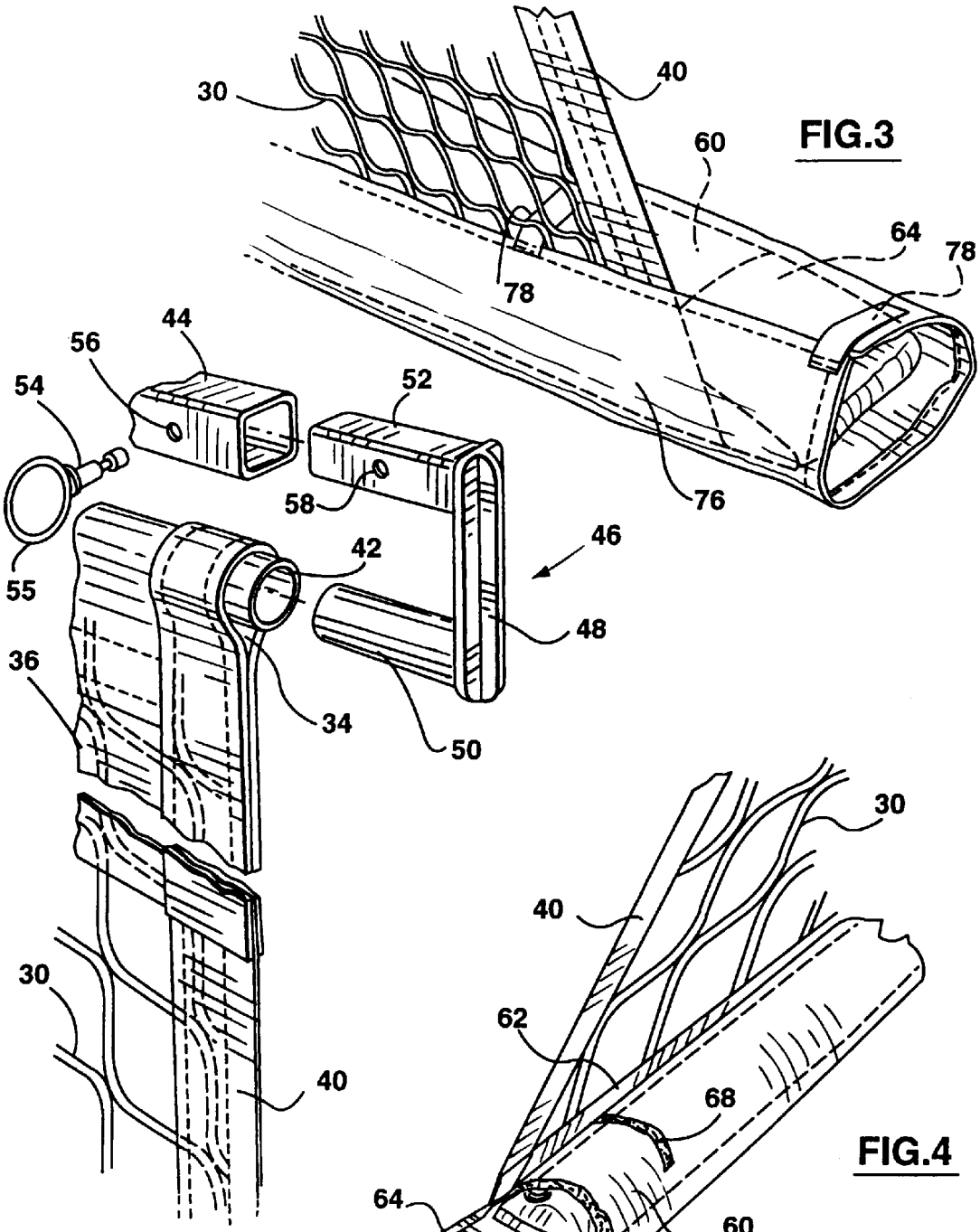
FIG.3
FIG.2
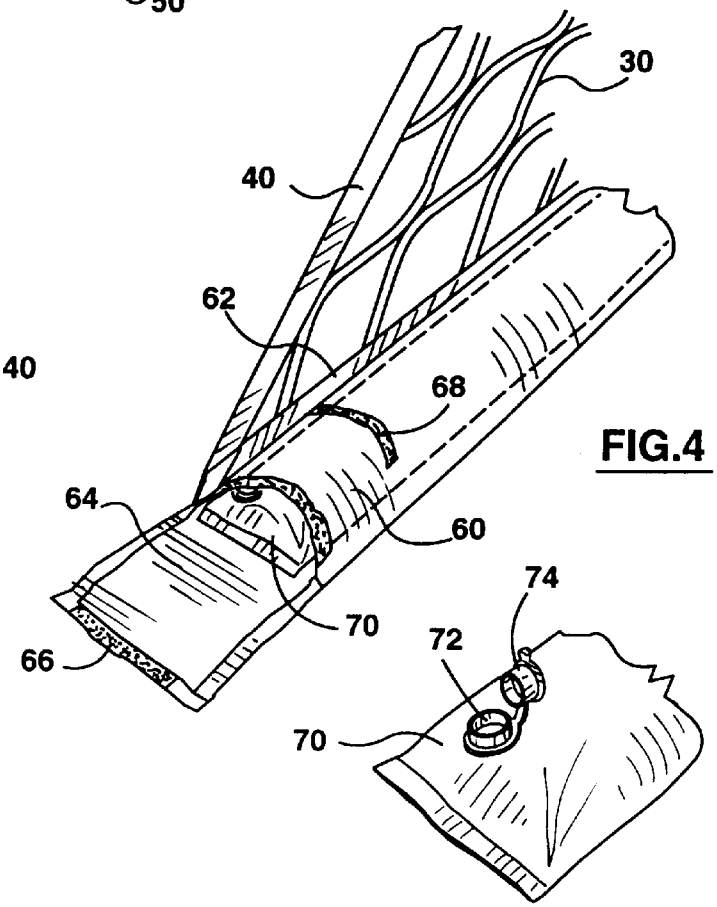
FIG.4

BASKETBALL RETURN NET ASSEMBLY

This application claims priority from U.S. Provisional Patent Application No. 60/063,168 filed Oct. 24, 1997.

FIELD OF THE INVENTION

This invention relates to basketball return net assemblies which are attachable to basketball hoop supports for returning basketballs to a thrower.

BACKGROUND OF THE INVENTION

Such return net assemblies have previously been proposed, but previous proposals have for one reason or another not been particularly satisfactory.

It is therefore an object of the invention to provide an improved net assembly of this kind.

SUMMARY OF THE INVENTION

According to the invention, a basketball return net assembly has a flexible foldable return net having an upper end with an upper sleeve portion extending therealong, an elongated rigid net-carrying member removably insertable into the upper sleeve portion to enable the net to be suspended in a laterally-extended configuration from the net-carrying member, at least one attachment member for securing the net-carrying member to an upper portion of the hoop support behind the hoop, and the net also having a lower end portion for receiving ballast to retain the lower end of the net in a laterally extended configuration at a selected location on the ground.

A basketball return net assembly in accordance with the invention not only returns a basketball to the thrower in a satisfactory manner but can also be efficiently packaged for marketing and easily secured to and detached from a hoop support.

One attachment member comprises an elongated rigid attachment member positionable adjacent the net-carrying member externally of the upper sleeve portion of the net and detachably securable to the net-carrying member.

The net assembly may also include a pair of attachment brackets, one attachment bracket being detachably securable to adjacent ends of the attachment member and the net-carrying member at one side of the net, and the other attachment bracket being detachably securable to adjacent ends of the attachment member and the net-carrying member at the other side of the net.

The attachment member and the net-carrying members may have hollow end portions, with the attachment brackets having attachment portions insertable into respective hollow end portions of the attachment member and the net-carrying member. The attachment member may comprise a tubular member of rectangular cross-section, with the net carrying member comprising a tubular member of circular cross-section.

The net assembly may also include a pair of pin members, one of the pin members being insertable through apertures in the attachment member and an inserted attachment portion of one of the adjustment brackets, and the other pin member being insertable in apertures in the attachment member and inserted attachment portion of the other attachment bracket to secure the attachment member to the net-carrying member.

The lower end portion of the net may have a lower sleeve portion extending therealong, and the net assembly may also include an elongated bag member fillable with ballast and insertable into the lower sleeve portion.

The net assembly may also include a further attachment member positionable on an opposite side of the upper portion of the hoop support to the first-mentioned attachment member and detachably securable thereto to detachably secure the first attachment member to the hoop support.

The further attachment member comprises a further elongated rigid member, which may be short in length relative to the length of the first attachment member.

The further attachment member may comprise a saddle member with an inwardly curved recess for use with an outwardly curved upper portion of the hoop support, and the net assembly may also include a further saddle member with an inwardly curved recess positionable between the first attachment member and the outwardly curved upper hoop support portion.

The net assembly may also include a flexible elongated carrying bag for carrying the net, the net-carrying member and the attachment member. The carrying bag may be capable of receiving the lower end of the net when the net assembly is secured to a hoop support such that the bag provides protection for the lower end of the net.

Figure 5:
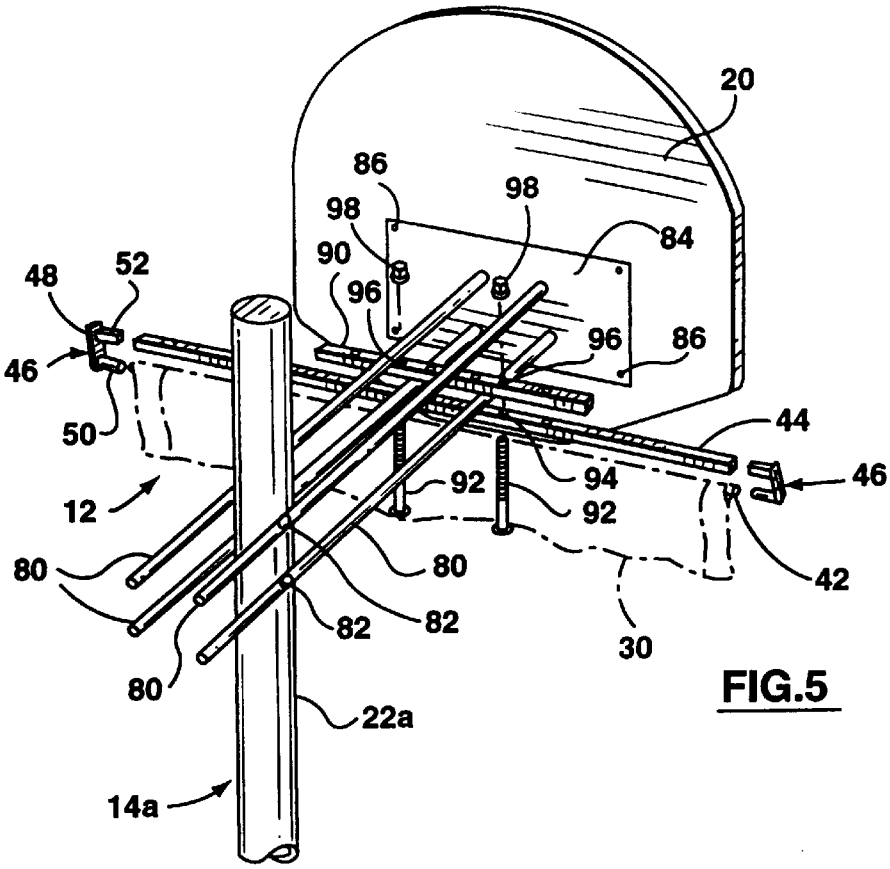
Figure 6:
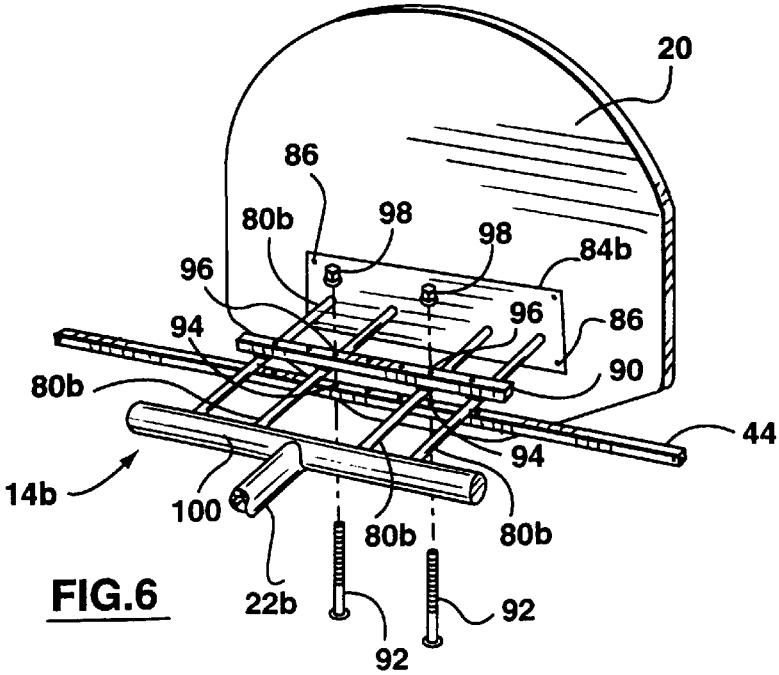
Figure 7:
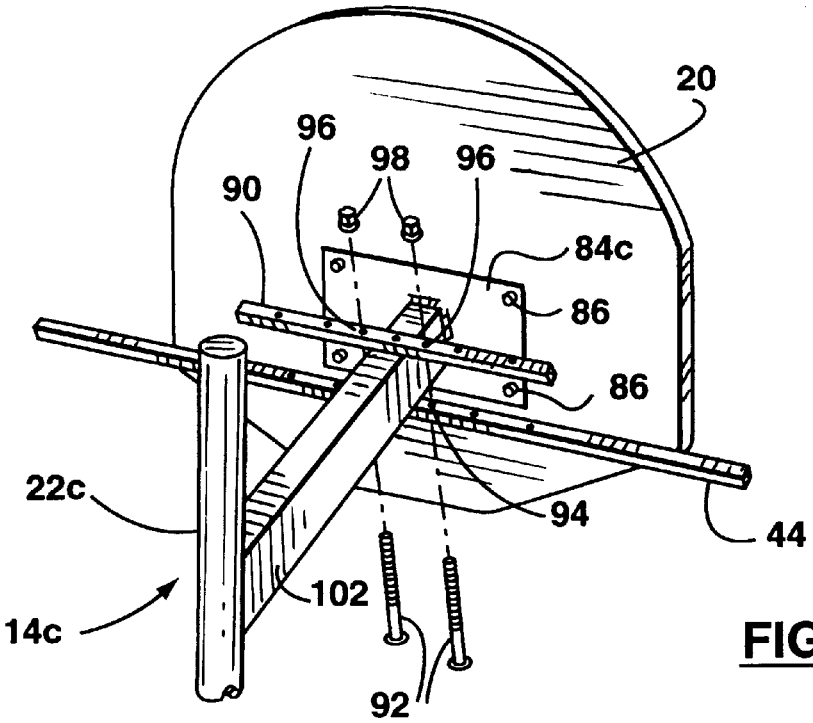
Figure 8:
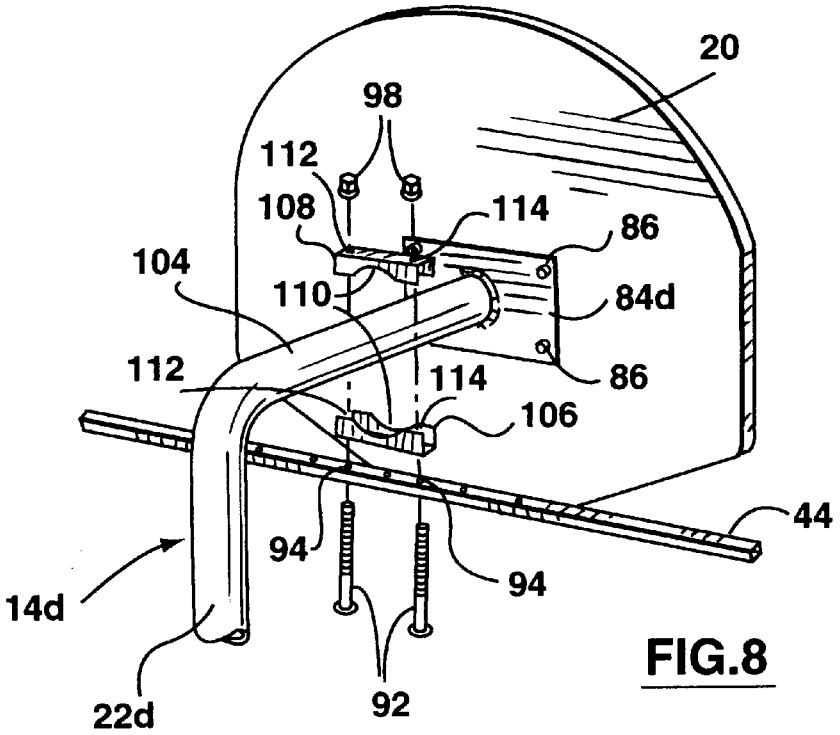
Figure 9:
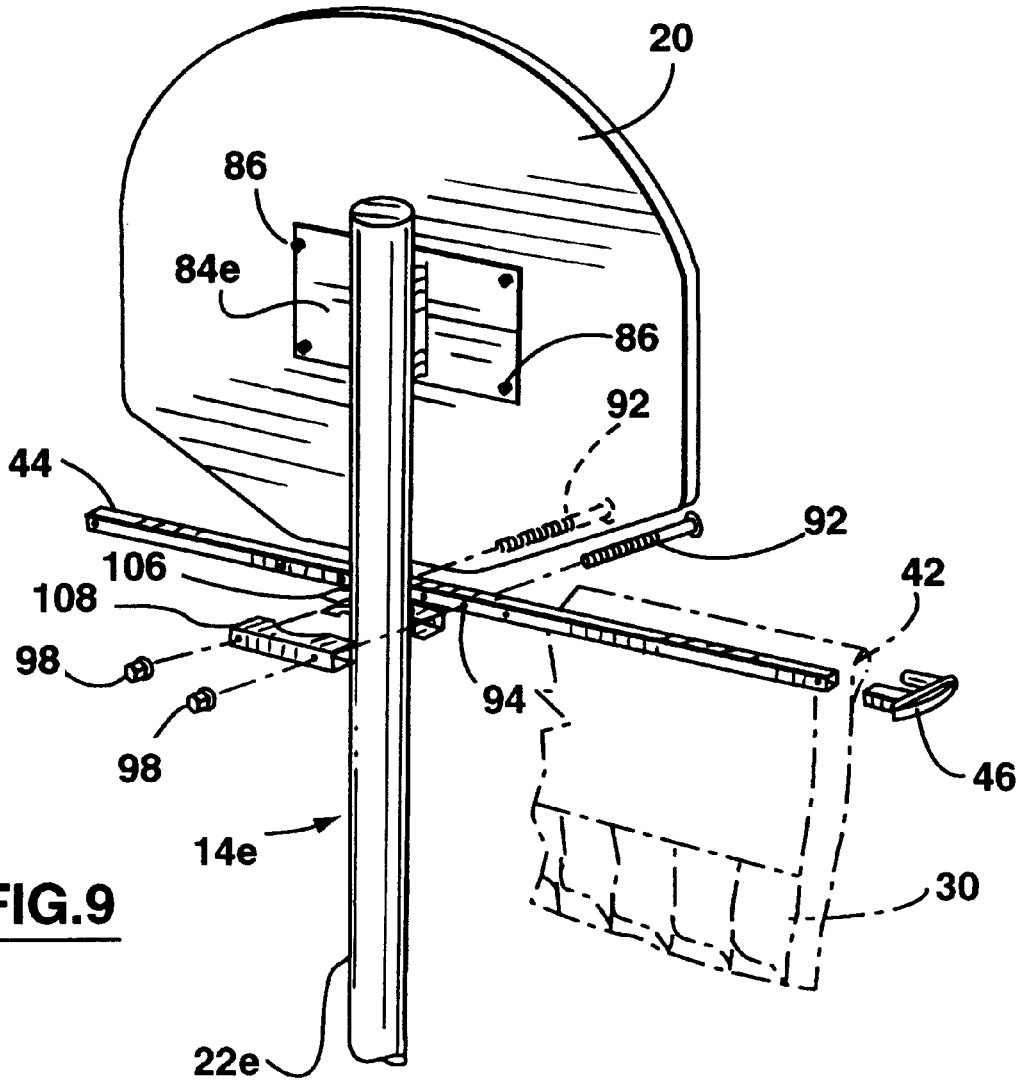
Figure 10:
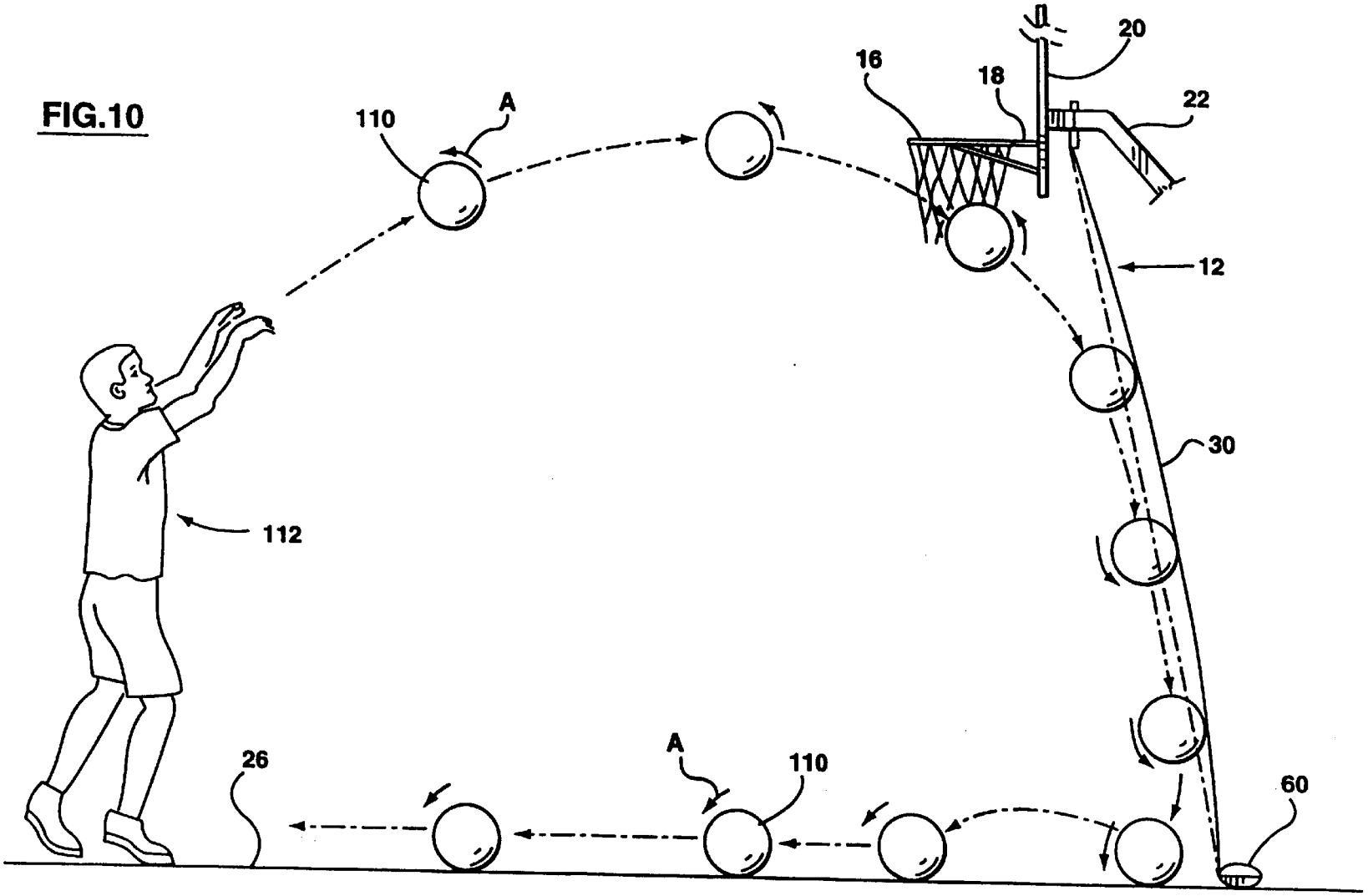
Figure 11:
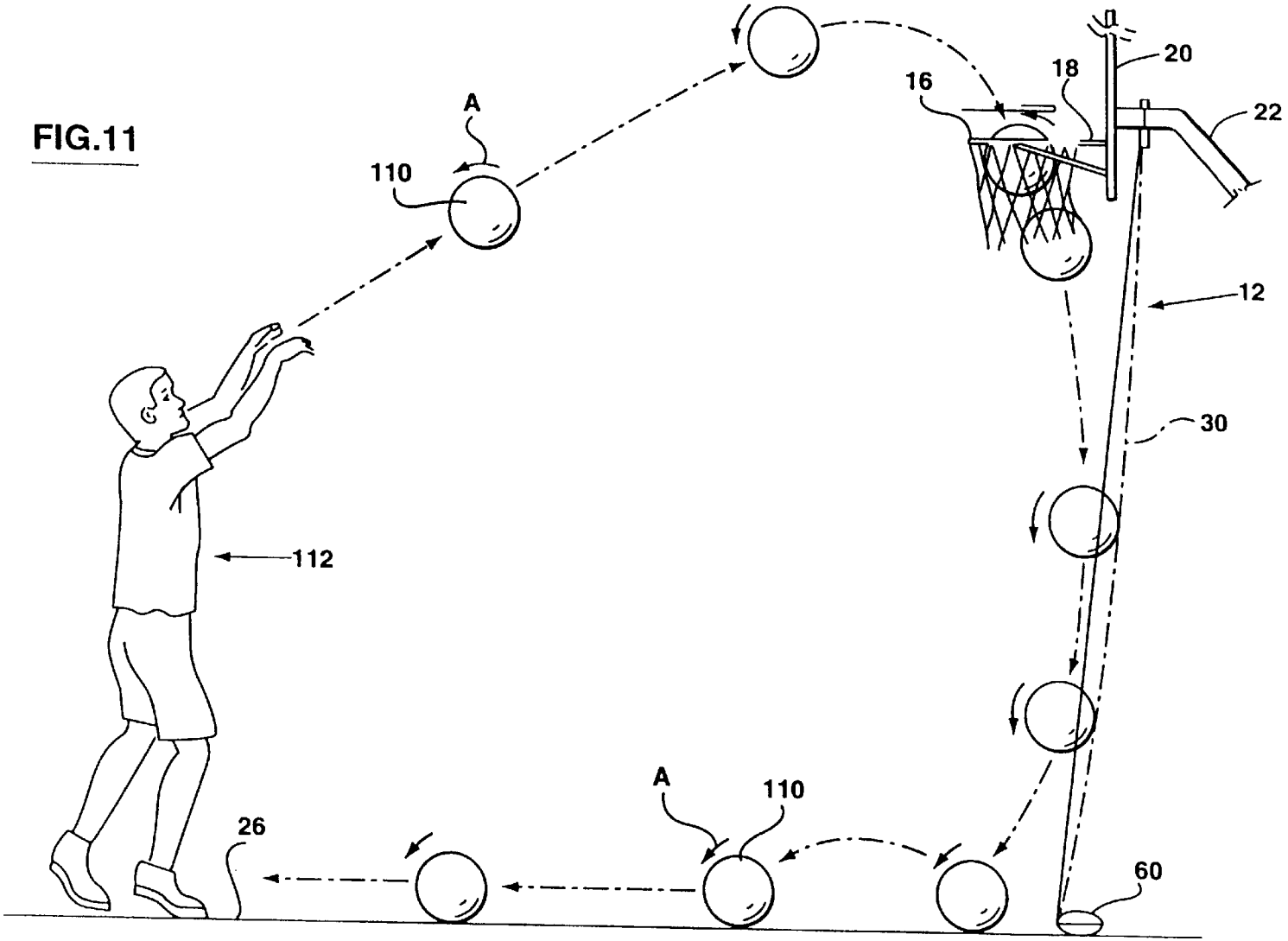

Embodiments of the invention will now be described, by way of example, with reference to the accompanying drawings, of which:

FIG. 1 is a front perspective view of a net assembly in accordance with one embodiment of the invention secured to a basketball hoop support, FIG. 2 is an exploded view on an enlarged scale of an upper corner portion of the net assembly showing how the attachment member is secured to the net-carrying member, FIG. 3 is a rear view on an enlarged scale of a lower corner portion of the net assembly showing how a carrying bag can be used to protect the lower end of the net, FIG. 4 is a similar view showing a ballast member within the lower sleeve portion of the net, FIG. 4A is a perspective view of an end portion of the ballast member, FIG. 5 is a rear perspective view of the upper portion of one type of hoop support showing the net assembly as secured thereto, FIG. 6 is a similar view showing how the net assembly is secured to another type of hoop support, FIG. 7 is a similar view showing how the net assembly is secured to a further type of hoop support, FIG. 8 is a similar view showing how the net assembly is secured to a still further type of hoop support, FIG. 9 is a similar view showing how the net assembly is secured to yet another type of hoop support, FIG. 10 is a side view showing a net assembly in accordance with the invention secured to a hoop support with the net extending downwardly therefrom in a rearwardly inclined manner, and also showing the trajectory of a basketball thrown by a thrower and missing the hoop, and FIG. 11 is a similar view but showing the net extending downwardly in a forwardly inclined manner and receiving a basketball which has passed through the hoop.

Referring to the drawings, FIG. 1 shows a basketball return net assembly 12 in accordance with one embodiment of the invention attached (in a manner to be described later) to a basketball hoop support 14 behind a basketball hoop 16 carried thereby. The hoop 16 is secured by a bracket 18 in known manner to a backboard 20 which is attached (also in a manner to be described later) to an upper portion of a support post 22 mounted on a base 24 suitably positioned on the ground 26. The hoop support 14 is a portable support of known kind which is frequently located on a house driveway for practice purposes.

The net assembly 12 includes a flexible foldable return net 30 with an upper sleeve portion 34 extending therealong at the top from one side to the other. The upper portion of the net 30 is secured by stitching to a plastic sheet member 36 which is folded over on itself at the top to provide the sleeve portion 34. The sides of the net 30 are stitched to folded-over strips of plastic material 38, 40.

As shown especially in FIG. 2, an elongated rigid net-carrying member in the form of a tubular member 42 of circular cross-section is removably inserted into the upper sleeve portion 34, the tubular member having a length approximately equal to the length of the sleeve portion 34. A first attachment member is in the form of a tubular member 44 of rectangular cross-section and with the same length as the net-carrying tubular member 42. A pair of attachment brackets 46 is also provided, for each side of the net 30. Each attachment bracket 46 has a manually-grippable base portion 48 with parallel attachment portions 50, 52 extending from one side thereof. The attachment portion 50 has a circular cross-section dimensioned to be a sliding fit in the end of the net-carrying tubular member 42, and the attachment portion 52 has a rectangular cross-section dimension to be a sliding fit in the tubular attachment member 44. Each bracket 46 is provided with a pin member 54 which is inserted through apertures 56, 58 in the tubular attachment member 44 and the attachment portion 52 respectively to secure the attachment brackets 46 in assembly with the attachment member 44 and the net carrying member 42. Each pin member 54 has a manually-grippable ring portion 56.

As shown especially in FIGS. 3, 4 and 4A, the net 30 also has a lower sleeve portion 60 extending therealong at the bottom from one side to the other. The lower portion of the net 30 is secured by stitching to a plastic sheet member 62 which is folded over on itself to provide sleeve portion 60. The plastic sheet material 62 has an extension flap 64 at each end providing a closure for each sleeve portion 60, each flap 64 being releasably securable in the closed position to the sleeve portion 60 by Velcro strips 66, 68. A ballast member in the form of an elongated pouch 70 of flexible plastic material is inserted into the sleeve portion 60, the ballast pouch 70 having first been filled with water through a filling aperture 72 provided with a releasable closure 74.

A carrying bag of flexible plastic material is provided for carrying the various components of the net assembly 12. If desired, and as shown in FIG. 3, the lower sleeve portion 60 of the net 30 may be placed in the carrying bag 76 for protection thereby, the carrying bags 76 being closable by straps 78 with Velcro fasteners.

In a particular preferred embodiment of the invention, the net 30 had an upper width of five feet, the sides being inclined downwardly and outwardly to provide a width of ten feet at the bottom, the length of the net from top to bottom being ? feet.

FIG. 5 shows a net assembly 12 as previously described secured to one known kind of hoop support 14*a* which has a vertical support post 22*a*. The backboard 20 is supported by four parallel support rods 80 which are attached to the support post 22*a* by pins 82 so that the support rods 80 can pivot about the pins 82 to enable the backboard 20, with of course the hoop (not shown in FIG. 5), to be raised or lowered. The support rods 80 are also secured to a support plate 84 which is attached by screws 86 to the rear of the backboard 20. Further details of the pivoting structure associated with the support rods 80 have been omitted for clarity, and will be readily apparent to a person skilled in the art since, as noted above, the hoop support 14*a* is of known kind.

In this embodiment, a further attachment member 90 is provided and is positioned above the lower two support rods 80. The further attachment is secured to the first attachment member 44, which is below the lower two support rods 80, by bolts 92 which pass through apertures 94, 96 in the attachment members 44, 90 and are retained in place by nuts 98. The further attachment member 90 is secured similar to the attachment member 44, i.e. it is a rigid metal tube of rectangular cross-section, but is much shorter in length.

FIG. 6 shows how a net assembly as previously described can be secured to a further known kind of hoop support 14*b*. For clarity, only the attachment members 64, 90 and bolts and nuts 92, 98 of the net assembly are shown. The hoop support 14*b* has a support post with a horizontal upper portion 22*b* which has a cross number 100 at the end thereof. The hoop support 14*b* also has four co-planar on the support rods 80*b* which extend from the cross member 100 to a support plate 84*b* secured to the rear of the backboard 20 by screws 86.

In this embodiment, the further attachment member 90 is located above the four support rods 80*b* with the attachment member 44 being located below the support rods 80*a* and secured to the further attachment member 90 by bolts and nuts 92, 98 as before.

FIG. 7 shows how a net assembly as previously described can be secured to yet another known kind of hoop support 14*c*. The hoop support 14*c* has a vertical support post 22*c* with an arm 102 of rectangular cross-section extending forwardly therefrom. The support arm 102 is secured by welding to a support plate 84*c* which is attached to the rear of the backboard 20 by screws 86. The further attachment member 90 is located above the support arm 102, with the attachment member 44 being located below the support arm 102 and secured to the attachment 90 by bolts and nuts 92, 98 as before.

FIG. 8 shows how a net assembly as previously described can be secured to another known kind of hoop support 14*d*. The hoop support 14*d* has a vertical support post 22*d* of circular cross-section and having a forwardly extending horizontal portion 104 at its upper end. This embodiment, instead of the further attachment member 90, two saddle members 106, 108 are used, each saddle member 106, 108 has an inwardly curved recess 110 and a pair of bolt receiving apertures 112, 114. One settle member 106 is position between the attachment member 44 and the post extension 104, with the recess 110 receiving the adjacent portion of the post extension 104. The other saddle member 108 is positioned above the first extension 104, with the recess 102 receiving the adjacent portion of the post extension 104. The bolts 92 are then passed through the apertures 94 in the attachment member 44, the apertures 112, 114 in the lower saddle member 106 and the apertures 112, 114 in the upper saddle member 118, with the bolts 192 then being retained by nuts 96.

FIG. 9 shows how the net assembly as previously described can be used with a still further known kind of hoop support 14*e*. The hoop support 14*e* has a vertical post 22*e* of circular cross-section, and a backboard support plate 84*e* is secured thereto by welding near the upper end thereof. The support plate 84*e* is secured to the rear of the backboard 20 by screws 86. In this embodiment, the screw saddle members 106, 108 are again used, with the attachment member 44 being turned 90° from the orientation previously used so that the apertures 94 extend horizontally instead of vertically as before. The saddle member 106 is again positioned between the attachment member 44 and the support post 22*e*, with the other saddle member 108 on the opposite side of the post 22*e*, and with the bolts 92 again passing through apertures in the attachment members 44 and the two saddle members 94, 96.

The foregoing description shows how the foregoing invention provides a net assembly which can be attached to many different kinds of hoop supports, and it will also be appreciated that the net assembly can be very conveniently packed in the carrying bag 76 so that it is readily portable, thereby providing significant marketing convenience. The relatively inexpensive nature of the net assembly will also be appreciated.

FIGS. 10 and 11 show two ways of using the net assembly 12. In FIG. 10, the lower sleeve portion 60 with ballast is positioned on the ground 26 so that the net 30 extends downwardly from the top of the support post 22 in a rearwardly inclined direction so as to return a basketball 110 which has missed the hoop 16 to a thrower 112. Backspin imparted to the ball 110 by the throw 112 is indicated by arrow A. The ball 110 rolls down the net 30 and returns along the ground 26 to the thrower 112. The rearward inclination of the net 30 and the consequent rearward location of the lower sleeve portion 60 minimizes obstruction to players around the net 16.

As shown in FIG. 11, the lower sleeve portion 60 may be moved forwardly to cause the net 30 to extend downwardly in a forwardly inclined manner. This is useful when the thrower 112 is merely making practice shots, with no one being near the net 30.

The net assembly 12 is provided with a net 30 of more than adequate length from top to bottom, so that the net assembly can be used with high as well as lower hoops 16. For lower hoops 16, it is simply necessary to wrap excess length of net 30 around the lower sleeve portion 60.

In the described embodiments, the sleeve portions 34, 60 extend continuously from one side of the net 30 to the other. It will be appreciated that this is not essential, since each sleeve portion may comprise a plurality of separate shorter sleeve portions. Also, instead of using the ballast pouch 70 filled with water for ballast, the ballast may alternatively be provided by filling the lower sleeve portion 60 with sand.

It will be appreciated that, although a net assembly in accordance with this invention is primarily intended for use in playing or practising basketball, it may also be used for practising other ball games, for example tennis, golf or baseball.

Other embodiments, advantages and uses of the invention will also be readily apparent to a person skilled in the art, the scope of the invention being defined in the appended claims.

I claim:

1. A basketball return net assembly attachable to a basketball hoop support behind a basketball hoop carried thereby, said net assembly having:

a flexible foldable return net having an upper end with an upper sleeve portion extending therealong, an elongated rigid net-carrying member removably insertable into the upper sleeve portion to enable the net to be suspended in a laterally-extended configuration from the net-carrying member, at least one attachment member for securing the net-carrying member to an upper portion of the hoop support behind the hoop, said at least one attachment member comprising an elongated rigid attachment member positionable adjacent the net-carrying member externally of the upper sleeve portion of the net and detachably securable to the net-carrying member, and the net also having a lower end portion for receiving ballast to retain the lower end of the net in a laterally configuration at a selected location on the ground.

2. A net assembly according to claim 1 also including a pair of attachment brackets, one attachment bracket being detachably securable to adjacent ends of the attachment member and the net-carrying member at one side of the net, and the other attachment bracket being detachably securable to adjacent ends of the attachment member and the net-carrying member at the other side of the net.

3. A net assembly according to claim 2 wherein the attachment member and the net-carrying member have hollow end portions, and the attachment brackets have attachment portions insertable into respective hollow end portions of the attachment member and the net-carrying member.

4. A net assembly according to claim 3 wherein the attachment member comprises a tubular member of rectangular cross-section, and the net carrying member comprises a tubular member of circular cross-section.

5. A net assembly according to claim 3 also including a pair of pin members, one of the pin members being insertable through apertures in the attachment member and an inserted attachment portion of one of the adjustment brackets, and the other pin member being insertable in apertures in the attachment member and inserted attachment portion of the other attachment bracket to secure the attachment member to the net-carrying member.

6. A net assembly according to claim 1 wherein the lower end portion of the net has a lower sleeve portion extending therealong, and the net assembly also includes an elongated bag member fillable with ballast and insertable into the lower sleeve portion.

7. A net assembly according to claim 1 also including a further attachment member positionable on an opposite side of the upper portion of the hoop support to the first-mentioned attachment member and detachably securable thereto to detachably secure the first attachment member to the hoop support.

8. A net assembly according to claim 7 wherein the further attachment member comprises a further elongated rigid member.

9. A net assembly according to claim 7 wherein the further attachment member is short in length relative to the length of the first attachment member.

10. A net assembly according to claim 7 wherein the further attachment member comprises a saddle member with an inwardly curved recess for use with an outwardly curved upper portion of the hoop support.

11. A net assembly according to claim 10 also including a further saddle member with an inwardly curved recess positionable between the first attachment member and the outwardly curved upper hoop support portion.

12. A net assembly according to claim 1 also including a flexible elongated carrying bag for carrying the net, the net-carrying member and the attachment member.

13. A net assembly according to claim 12 wherein the carrying bag can receive the lower end of the net when the net assembly is secured to a hoop support such that the bag provides protection for the lower end of the net.

14. A basketball hoop support with a basketball return net assembly attached behind a basketball hoop carried thereby, said net assembly having:

a flexible foldable return net having an upper end with an upper sleeve portion extending therealong, an elongated rigid net-carrying member removably insertable into the upper sleeve portion to enable the net to be suspended in a laterally-extended configuration from the net-carrying member, at least one attachment member for securing the net-carrying member to an upper portion of the hoop support behind the hoop, said at least one attachment member comprising an elongated rigid attachment member positionable adjacent the net-carrying member externally of the upper sleeve portion of the net and detachably securable to the net-carrying member, and the net also having a lower end portion for receiving ballast to retain the lower end of the net in a laterally configuration at a selected location on the ground.

15. A hoop support according to claim 14 including a pair of attachment brackets, one attachment bracket being detachably secured to adjacent ends of the attachment member and the net-carrying member at one side of the net, and the other attachment bracket being detachably secured to adjacent ends of the attachment member and the net-carrying member at the other side of the net.

16. A hoop support according to claim 15 wherein the attachment member and the net-carrying member have hollow end portions, and the attachment brackets have attachment portions inserted into respective hollow end portions of the attachment member and the net-carrying member.

17. A hoop support according to claim 16 wherein the attachment member comprises a tubular member of rectangular cross-section, and the net carrying member comprises a tubular member of circular cross-section.

18. A hoop support according to claim 16 also including a pair of pin members, one of the pin members being inserted through apertures in the attachment member and an inserted attachment portion of one of the adjustment brackets, and the other pin member being inserted in apertures in the attachment member and inserted attachment portion of the other attachment bracket to secure the attachment member to the net-carrying member.

19. A hoop support according to claim 14 wherein the lower end portion of the net has a lower sleeve portion extending therealong, and the net assembly also includes an elongated bag member filled with ballast and inserted into the lower sleeve portion.

20. A hoop support according to claim 14 also including a further attachment member positioned on an opposite side of the upper portion of the hoop support to the first-mentioned attachment member and detachably secured thereto to detachably secure the first attachment member to the hoop support.

21. A hoop support according to claim 20 wherein the further attachment member comprises a further elongated rigid member.

22. A hoop support according to claim 20 wherein the further attachment member is short in length relative to the length of the first attachment member.

23. A hoop support according to claim 20 wherein the further attachment member comprises a saddle member with an inwardly curved recess engaging an outwardly curved upper portion of the hoop support.

24. A hoop support according to claim 23 also including a further saddle member with an inwardly curved recess positioned between the first attachment member and the outwardly curved upper hoop support portion.

25. A hoop support according to claim 14 also including a flexible elongated carrying bag for carrying the net, the net-carrying member and the attachment member.

26. A hoop support according to claim 25 wherein the carrying bag receives the lower end of the net such that the bag provides protection for the lower end of the net.

* * * * *